United States Patent [19]

Maravelas, Jr. et al.

[11] 4,433,880

[45] Feb. 28, 1984

[54] FREE STANDING MODULAR UNIT FOR STORING, DISPLAYING, AND SELLING MERCHANDISE

[75] Inventors: William S. Maravelas, Jr., Maple Grove; Alexandria D. Bighley, Arden Hills; Marco A. Calabrese, Minneapolis, all of Minn.

[73] Assignee: Deck the Halls, Inc., Roseville, Minn.

[21] Appl. No.: 420,421

[22] Filed: Sep. 20, 1982

[51] Int. Cl.[3] ..... A47F 3/14

[52] U.S. Cl. ..... 312/3; 312/114; 312/223; 312/257 R; 312/263; 312/345

[58] Field of Search ..... 312/3, 4, 5, 257 R, 312/263, 264, 345; 108/107; 52/18, 90; 211/180, 190, 57.1, 59.1

[56] References Cited

U.S. PATENT DOCUMENTS

| | | | |
|---|---|---|---|
| 373,447 | 11/1887 | Ely | 312/3 X |
| 3,681,881 | 8/1972 | Baran | 52/38 |
| 3,770,134 | 11/1973 | Kupcikevicius | 211/57.1 |
| 3,856,370 | 12/1974 | Burrell | 312/118 |
| 3,868,081 | 2/1975 | Morgan et al. | 108/107 X |
| 3,899,228 | 8/1975 | Schreiber | 312/257 R |
| 4,357,782 | 11/1982 | Peter | 52/18 |

FOREIGN PATENT DOCUMENTS

| | | | |
|---|---|---|---|
| 218108 | 4/1924 | United Kingdom | 312/345 |

*Primary Examiner*—William E. Lyddane
*Assistant Examiner*—Joseph Falk
*Attorney, Agent, or Firm*—Wicks & Nemer

[57] ABSTRACT

A free standing modular unit for storing, displaying, and selling merchandise is shown in the preferred embodiment including standarized parts which can be assembled and disassembled without the use of tools by unskilled labor. According to the teachings of the present invention, the unit is constructed of non-combustible or fire treated material and includes a generally open top and sides which can be opened and closed by rolling up or down flexible coverings to maximize fire protection while minimizing expense. The unit includes a plurality of posts interconnected to and spaced by members locked thereto by visually hidden locking members. The open ceiling is formed by lattice grids resting on lips formed on the post separation and connector members. Merchandise storing, displaying, and holding members are provided in various forms including peg boards, shelf members, and cabinets. Dowels extending through apertures formed in the merchandise storing, displaying, and holding members and into apertures formed in the posts attach these components together without the use of tools. The corner posts include perimeter edge extenders for preventing the flexible covering from damaging the merchandise storing, displaying, and holding members and the merchandise thereon.

11 Claims, 8 Drawing Figures

FREE STANDING MODULAR UNIT FOR STORING, DISPLAYING, AND SELLING MERCHANDISE

BACKGROUND

The present invention relates generally to modular units, particularly to free standing modular units, and more particularly to free standing modular units for storing, displaying, and selling merchandise.

With the rising popularity of shopping malls, an increasing demand has arisen for kiosks and similar units which can be temporarily set up in the mall area of shopping malls for the seasonal sale of merchandise. Prior units had several problems because they were not of modular construction utilizing standard components, had to be assembled by skilled labor, required extensive and expensive construction to meet fire codes, could be set up only in a single configuration, and like disadvantages.

SUMMARY

The present invention solves these problems and disadvantages by providing in the preferred embodiment a free standing modular unit for storing, displaying, and selling merchandise. The unit includes a plurality of elongated posts separated and connected by a plurality of members in a visually hidden locking manner. The unit includes a generally open ceiling which allows water to pass therethrough while presenting an aesthetic appearance. The unit includes flexible coverings for selectively closing the perimeter of the modular unit. Perimeter edge extenders are located at least on the corner posts of the unit to prevent the flexible covering from damaging the merchandise storing, displaying, and holding members and the merchandise located thereon. The components of the unit are formed from non-combustible or fire rated material so that the unit is safe from fire. Furthermore, the modular unit can be assembled and disassembled without the use of tools.

Therefore, it is a primary object of the present invention to provide a novel free standing modular unit.

It is also an object of this invention to provide a novel free standing modular unit for storing, displaying, and selling merchandise.

It is also an object of this invention to provide such a novel modular unit which can be assembled by unskilled labor.

It is also an object of this invention to provide such a novel modular unit which can be easily and rapidly assembled and disassembled.

It is also an object of this invention to provide such a novel modular unit which can be assembled in a variety of configurations.

It is also an object of this invention to provide such a novel modular unit which can be reused with no or minimal repair.

It is also an object of this invention to provide such a novel modular unit which can be assembled without the use of tools.

It is also an object of this invention to provide such a novel modular unit which meets fire code requirements without extensive and expensive constructional steps and components.

It is also an object of this invention to provide such a novel modular unit which maximizes material.

It is also an object of this invention to provide such a novel modular unit which utilizes standard components.

It is also an object of this invention to provide such a novel modular unit which can be inexpensively shipped.

These and further objects and advantages of the present invention will become clearer in light of the following detailed description of an illustrative embodiment of this invention described in connection with the drawings.

DESCRIPTION OF THE DRAWINGS

The illustrative embodiment may best be described with reference to the accompanying drawings where.

Figures 1, 3:
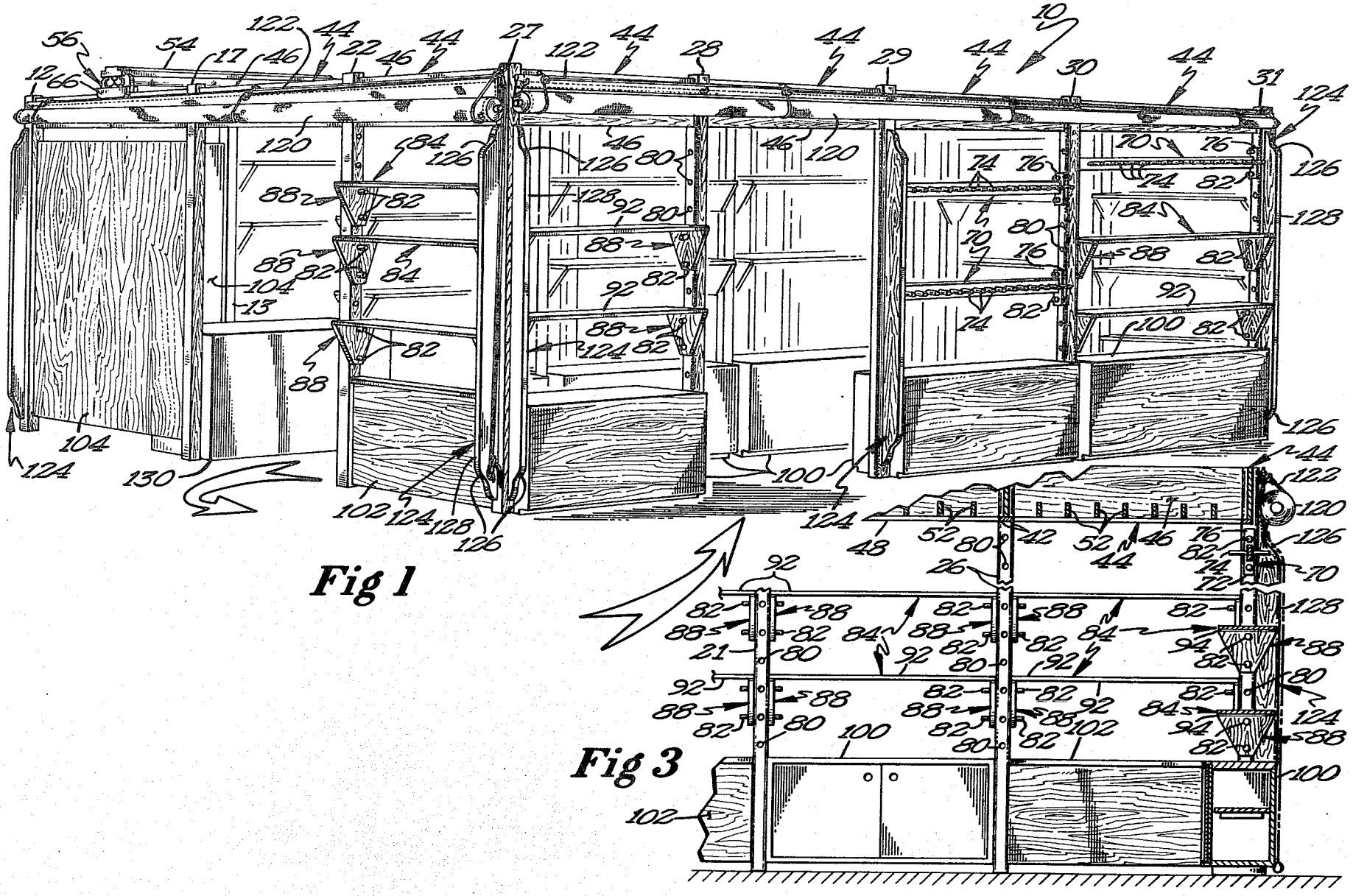
FIG. 1 shows a perspective view of a free standing modular unit for storing, displaying, and selling merchandise according to the teachings of the present invention.
FIG. 3 shows a cross sectional view of the modular unit of FIG. 1 according to section line 3—3 of FIG. 2.

All figures are drawn for ease of explanation of the basic teachings of the present invention only; the extensions of the figures with respect to number, position, relationship, and dimensions of the parts to form the preferred embodiment will be explained.

Where used in the various figures of the drawings, the same or similar numerals designate the same or similar parts of the various components of the modular unit. Furthermore, when the terms "right", "left", "top", "bottom", "vertical", "horizontal", "first", "second", and similar terms are used herein, it should be understood that these terms have reference only to the structure shown in the drawings as it would appear to a person viewing the drawings and are utilized only to facilitate describing the invention.

DESCRIPTION

A modular unit according to the teachings of the present invention for free standing use is shown in the drawings and generally designated 10. Unit 10 generally includes square posts 12–31 having upper ends and lower ends. Posts 12–17, 21, 22, and 26–31 are located on the perimeter of unit 10 and the remaining posts 18–20 and 23–25 are located in the interior of unit 10. Interconnected to and between interior posts 18–20 and 23–25 are inverted T-shaped members 38. Members 38 generally include a vertical member 40 and a perpendicular member forming lips 42 on both sides of member 40. Interconnected between posts 12–17, 21, 22, and 26–31 are L-shaped members 44. Member 44 generally includes a vertical member 46 and a lip 48 which extends on one side of member 46. The other side of member 46 can include any desired decorative surface. In the preferred embodiment, members 38 and 44 have the same length to allow their interchangement in unit 10 and act as separation and connector members in unit 10.

Figure 4:
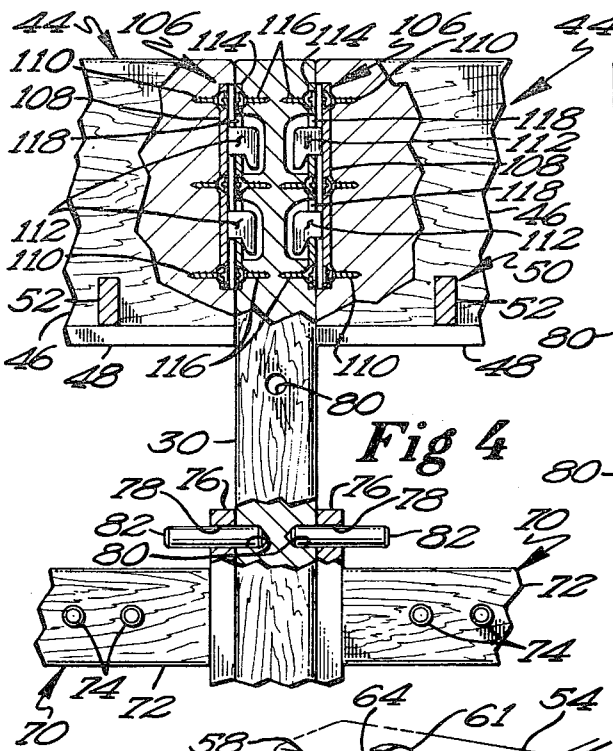
FIG. 4 shows a cross sectional view of the apparatus of FIG. 1 according to section line 4—4 of FIG. 2.
Figure 7:
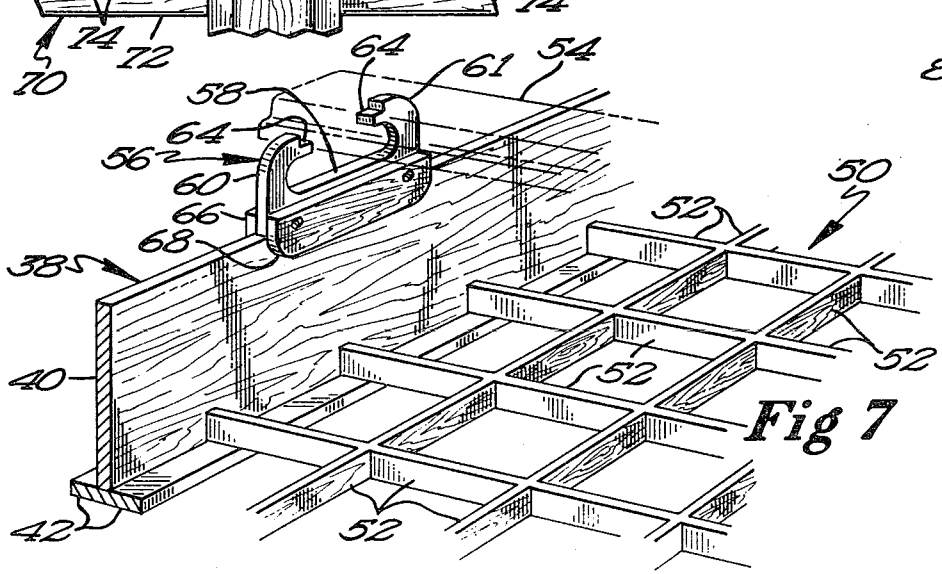
FIG. 7 shows a partial perspective view of the apparatus of FIG. 1.

Members 38 and 44 are connected to posts 12–31 by members 106 which provide visually hidden locking between members 38 and 44 and posts 12–31. As best seen in FIG. 4, members 106 include a first plate 108 attached to the ends of members 38 and 44 by suitable fastening members 110 such as screws, as shown. First and second hooks 112 extend from plate 108. Members 106 further include a second plate 114 attached to posts 12–31 by suitable fastening members 116 such as screws, as shown. Plate 114 and posts 12–31 include first and second apertures 118 for receipt and interlocking with hooks 112 of plate 108.

Thus, it should be appreciated that members 38 and 44 can be interlocked to or removed from posts 12–31 very easily and rapidly without the use of tools. Specifically to interlock members 38 and 44 to posts 12–31, it is simply necessary to insert hooks 112 into apertures 118, and allow hooks 112 to hook unto and interlock with apertures 118 of plate 114. To remove members 38 or 44 from posts 12–31, it is simply necessary to reverse this procedure.

Members 106 then provide a strong and tight interconnection due to the close tolerances allowed and the provision of two independent interconnections i.e. two hooks 112 and their complimentary apertures 118. Because of the weight of posts 12–31 and members 38 and 44 and the strong interconnection provided by members 106, unit 10 is self supported and free standing without any other further structural support. In the preferred embodiment, posts 12–31 include levelers, not shown, located in their bottom ends to insure simultaneous contact of posts 12–31 with the support surfaces such as the existing floor in a shopping mall.

Furthermore, it can be appreciated that due to this strong, integral connection, some of the posts 18–20 and 23–25 located in the interior of unit 10 can be cut below members 38 so that less obstruction is presented in the interior of unit 10 and without danger to the self-supporting and free standing nature of unit 10. Thus, members 106 provide a sturdy and visually hidden method of interconnection which can be rapidly assembled or disassembled without the use of tools.

Supported by lips 42 and 48 of members 38 and 44 are lattice grids 50. Grids 50 are formed intersecting strips 52 having free ends which lay upon lips 42 and 48. Thus, grids 50 require no securing of any kind, such as screws or nails. Therefore, grids 50 can be rapidly positioned or removed from unit 10 without the use of tools of any kind.

For providing light to the interior of unit 10, light fixtures 54, shown in the preferred embodiment of the flourescent type, are provided supported by support members 56. Members 56 include a central member 58 interconnected to the bottom or lower ends of first and second C-shaped members 60 and 61 which face each other. The upper ends of members 60 and 61 include light fixture holding members 64 shown in the preferred embodiment as L-shaped abutments upon which fixtures 54 rest and are captured. Members 56 include first and second parallel spaced side members 66 and 68 attached to and extending below member 58. Thus, member 56 can be positioned such that the upper or top end of members 40 and 46 is located and captured between side members 66 and 68 and the bottom side of interim or central member 58 rests upon the top end of members 40 and 46. Thus, members 56 are not attached to be simply rest upon members 38 and 44. Likewise, fixtures 54 rest upon but are not attached to members 64 of members 56. Therefore, fixtures 54 and members 56 can be rapidly positioned or removed from unit 10 without the use of tools.

Further provided in the preferred embodiment of the present invention are various members for holding, storing and/or displaying merchandise. Specifically, peg board 70 is provided including a vertical member 72 having a length substantially equal to but less than the spacing between posts 12–31. Merchandise holding pegs 74 extend generally horizontally from member 72 for holding merchandise. In the preferred embodiment, pegs 74 extend from both sides of member 72, and particularly pegs 74 extend through member 72. Board 70 further includes generally vertical members 76 having a horizontal width substantially equal to the horizontal width of posts 12–31 and a vertical height which is greater than the vertical height of member 72. Members 76 are attached to both ends of member 72 and further include apertures 78 formed above and below member 72.

For attaching the merchandise displaying, storing, and holding members to posts 12–31, apertures 80 are provided in posts 12–31 for receiving dowels or hook pegs 82. In the preferred embodiment, perimeter posts 12–17, 21, 22, and 26–31 include apertures 80 only in the post surfaces which face another post and do not include apertures in perimeter post surfaces while interior posts 18–20 and 23–25 include apertures 80 on all four post surfaces. For example, in attaching pegboard 70 to posts 12–31, dowels 82 are extended through apertures 78 of members 76 into apertures 80 of posts 12–31 between which peg board 70 is located. It can then be appreciated that pegboard 70 can be rapidly positioned or removed from posts 12–31 without the use of tools.

Also provided are shelf members shown in the preferred forms of the glass shelf type 84 or the wood shelf type 86. Shelves 84 and 86 generally include a shelf holding member 88 for attachment to posts 12–31. In the preferred embodiment, members 88 have the shape of isosceles trapezoids and include first and second apertures 90 formed therethrough. Thus, members 88 can be attached to posts 12–31 at the desired locations by dowels 82 which extend through apertures 90 of member 88 and into apertures 80 of posts 12–31. A glass shelf member 92 having a length substantially equal to but slightly less than the spacing between posts 12–31 is further provided for positioning on top of and between two members 88 located on adjacent posts 12–31. Shelf member 92 rests upon the top edge of members 88 which in the preferred embodiment is the base of the isosceles trapezoid. Double sided tape 94 is further provided between shelf member 92 and the top edge of member 88 for preventing shelf 92 from sliding on members 88.

In a similar manner, wood shelf 86 includes a wood shelf member 96 and in the preferred embodiment further includes end members 98 which upstand from the ends of shelf member 96. Wood shelf member 96 has a length generally equal to but slightly less than the spacing between posts 12–31. In a similar manner as glass shelf 84, shelf member 96 rests upon tape 94 located on the top edge of members 88.

Also provided in the preferred embodiment are cabinets 100. Cabinets 100 generally include first and second ends, a front, a back, a top, and a bottom. Cabinets 100 can be of various constructions, for example of wood or glass and can include various entry methods such as hinged doors, sliding doors, or simply an opening formed in one or more of sides of cabinets 100. Likewise, cabinet 100 can be divided into compartments if desired for example by intermediate shelves.

Cabinets 100 can be positioned on the floor or at the desired vertical location and attached between posts 12–31 for example by dowels 82 which extend through the ends of cabinet 100 and into apertures 80 of posts 12–31. Likewise, angle or L-shaped members can be provided having a first leg attached to post 12–31 and a second leg attached to cabinet 100 such as by screws. However, in the preferred embodiment, cabinets 100 rest on the floor between the desired posts 12–31 without attachment thereto. Therefore, cabinets 100 can be rapidly positioned and removed from unit 10 without the use of any tools.

Unit 10 further includes panels for attachment between selected perimeter posts 12–17, 21, 22, 26, and 27–31. For examples, partial panels 102 can be provided below pegboards 70 or shelves 84 and 86 and can be provided in corners of unit 10 where cabinets 100 are located. Further full panels 104 can be provided between slected posts 12–31, as desired. Panels 102 and 104 can be attached to posts 12–31 by any suitable method, for example, by angle or L-shaped members in a similar manner as previously set forth for cabinets 100.

Entry into the interior of unit 10 can be provided by suitable methods such as by doors. In the preferred embodiment of the present invention, nothing is placed between perimeter posts 12–17, 21, 22, and 26–31 where entry into unit 10 is desired. Thus, no tools or construction steps are required for providing entry into unit 10.

Figure 2:
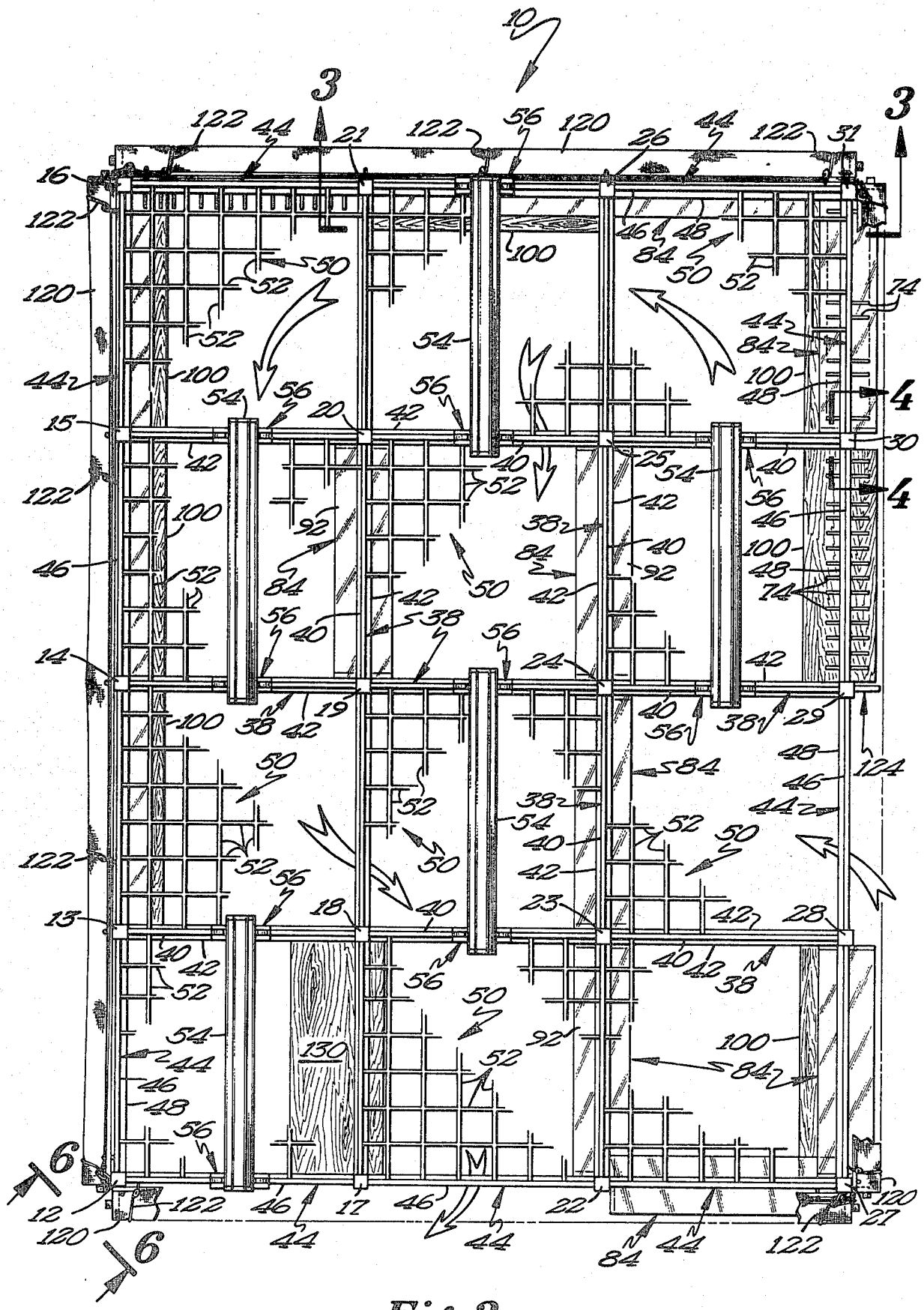
FIG. 2 shows a top plan view of the modular unit of FIG. 1.

As best seen in FIG. 2, unit 10 can further include a sales counter 130, located in the preferred embodiment between a perimeter post and an interior post. Counter 130 can then include a space for a cash register, merchandise packaging such as boxes and bags, and like sales paraphernalia.

It can then be appreciated that unit 10 as previously described allows customers to view and remove articles on display from peg boards 70, shelves 84 or 86 from either the interior or the exterior of unit 10. Thus, unit 10 maximizes sales area while requiring minimal floor space.

Figure 6:
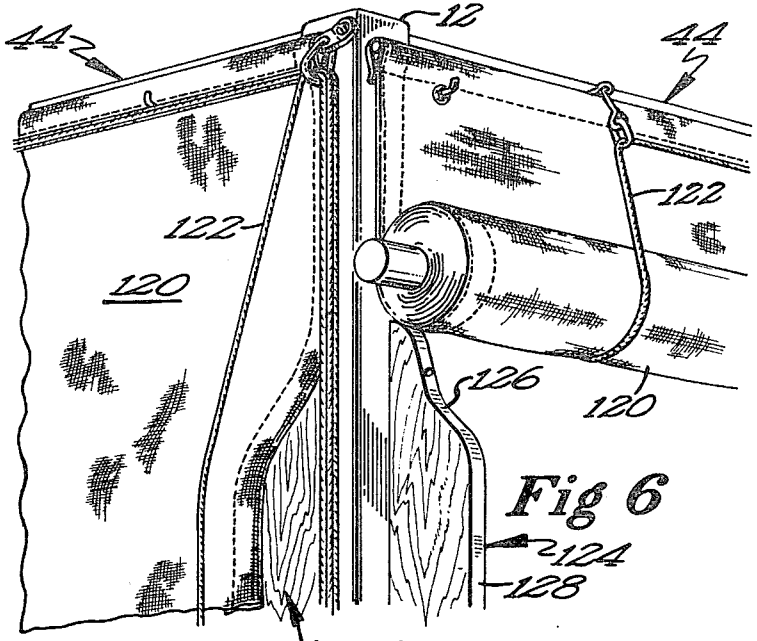
FIG. 6 shows a partial view of the apparatus of FIG. 1 according to view line 6—6 of FIG. 2.
Figure 8:
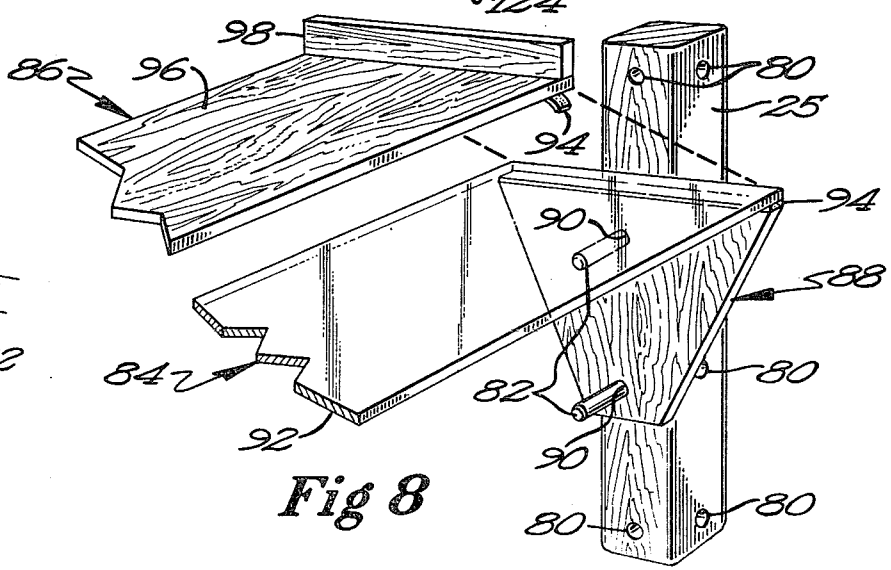
FIG. 8 shows two forms of merchandise storing, displaying, and holding members of the modular unit of FIG. 1.
Figure 5:
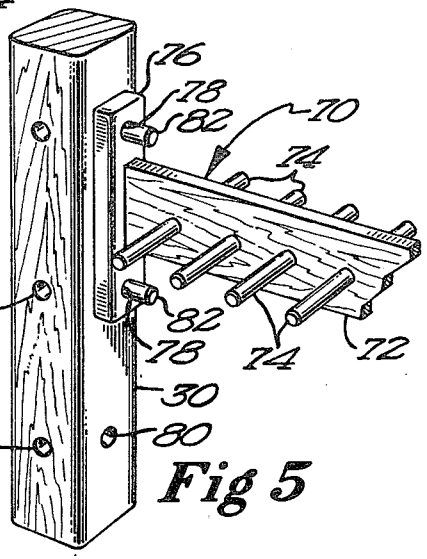
FIG. 5 shows a partial perspective view of a merchandise storing, displaying, and holding member of the modular unit of FIG. 1.

To provide security for unit 10 during non-sale periods, closures 120 shown in the preferred embodiment as canvas coverings are provided. Specifically, in the preferred embodiment, coverings 120 are provided attached to members 44 which cover an entire perimeter side of unit 10 in a lowered, unrolled, secured position as best seen in FIG. 6 or which can be rolled in an upper, rolled, open position as best seen in FIGS. 1 and 6 adjacent members 44. In the preferred embodiment, closures 120 are raised and lowered by drawstrings 122. In the preferred embodiment, coverings 120 are fire treated to obtain a non-combustible rating.

As best seen in FIGS. 2 and 3, peg boards 70, shelves 84 and 86 and cabinets 100 extend beyond the outside perimeter formed by perimeter posts 12–17, 21, 22, and 26–31. To prevent coverings 120 from damaging peg boards 70, shelves 84 and 86, and cabinets 100, or merchandise located thereon, perimeter edge extenders 124 are provided at least on corner posts 12, 16, 27, and 31. Extenders 124 are generally vertical elongated members having top and bottom cam contoured edges 126. Thus, as coverings 120 are being unrolled from its upper, open position as best seen in FIGS. 1, 3, and 6, coverings 120 engage with and follow top edge 126, follow the elongated side 128 of extenders 124, and can be pulled tight against lower edge 126 to provide a very tight closure and still avoid damaging interaction with peg boards 70, shelves 84 and 86, and cabinets 100 or merchandise located thereon. Furthermore, when strings 122 are pulled tight, coverings 120 cannot be raised away from extenders 124 to allow potential thieves from reaching into unit 10.

Now that a construction of unit 10 of the preferred embodiment of the present invention has been set forth, subtle features and advantages of the present invention can be appreciated.

First, unit 10 is completely modular and standardized so that standard parts can be manufactured which can then be utilized to construct units 10 of varying sizes and shapes. Furthermore, peg boards 70, shelves 84 and 86, and cabinets 100 can be located wherever desired and can be easily moved to differing positions in unit 10. Furthermore, unit 10 can be easily disassembled without damage allowing its ready reuse.

Second, unit 10 meets the National Fire Protection Code. Specifically, grids 50 provide an open ceiling such that unit 10 does not require a sprinkler system but can rely upon the sprinkler system of the building in which unit 10 is located, such as in a shopping center. Further, in the preferred embodiment, the components of unit 10 are formed of noncombustible material such as glass or utilizes fire treated material such as wood. Furthermore, coverings 120 as described in the preferred embodiment of the present invention does not stop ventilation and thus draft curtains or fire doors are not required.

Third, since unit 10 can be easily assembled or disassembled without the use of tools, skilled labor such as carpenters are not required. Thus, the cost for labor can be greatly reduced.

Fourth, in the preferred embodiment, posts 12–31 and members 38 and 44 are formed from solid No. 2 pine. These members can be shipped common freight without the need for crating of any kind. Thus, unit 10 can be shipped relatively inexpensively.

Fifth, although unit 10 occupies relatively little floor space, unit 10 provides a comfortable, open feeling to customers located in the interior of unit 10 due to the large open spaces between the merchandise holding, storing and displaying members. Furthermore, as set forth hereinbefore, since merchandise can be removed from both the interior and exterior of unit 10, sales and display area is maximized.

Sixth, unit 10 according to the teachings of the present invention has relatively large merchandise display and storage areas. Therefore, the requirement for additional storage of merchandise away from unit 10 is removed or greatly reduced.

The above then set forth a few of the advantages of the present invention. Further advantages will be known and will be obvious to persons skilled in the art after the teachings of the present invention become known.

Now that the basic teachings of the present invention have been explained, many extensions and variations will be obvious to one having ordinary skill in the art. For example, although the preferred embodiment of the merchandise storing, displaying, and holding members are shown as cabinets, peg boards, and shelves, other members can be added to or substituted for these members.

Furthermore, unit 10 according to the teachings of the present invention comprises several unique and novel features to arrive at a particularly synergistic article. Persons skilled in the art could construct units which utilize only partial of the totality of features of the modular unit of the present invention which would also be advantageous over prior devices.

Thus, since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rather than by the foregoing description and all changes which come within the meaning and range of equivalency of the claims are intended to be embraced therein.

What is claimed is:

1. Free standing modular unit for storing, displaying, and selling merchandise comprising, in combination: a plurality of elongated posts having top ends and bottom ends, with some of the posts being perimeter posts and some of the posts being interior posts, with some of the perimeter posts being corner posts; a plurality of members for separating and connecting the posts, with the post separation and connector members having first and second ends; means for providing visually hidden locking between the ends of the post separation and connector members and the elongated posts adjacent their top ends without the use of tools, with the visually hidden locking means comprising at least a first hook extending from either the end of the post separation and connector member or the post adjacent the top end and a complementary aperture formed in the other of the separation and connector member or the post for receipt of and interlocking with the hook; a generally open ceiling which allows water to pass therethrough, which presents an aesthetic appearance, and which can be assembled in the modular unit without the use of tools comprising: lattice grids formed of intersecting elongated strips having free ends, and with the post separation and connector members including lips for receipt of and supporting the free ends of the intersecting elongated strips forming the lattice grids; means for selectively closing the perimeter surface of the modular unit without requiring fire doors or draft curtains comprising: flexible coverings formed of non-combustible or fire treated materials; and means for rolling and unrolling the covering from an unrolled positioned closing the perimeter surface of the modular unit to a rolled position adjacent the top ends of the elongated perimeter posts; merchandise storing, displaying and holding members; means for attaching the merchandise storing, displaying and holding members to the posts comprising: apertures formed in the elongated posts between their top and bottom ends; apertures formed in the merchandise storing, displaying, and holding members; and dowels having a size and length for passing through the apertures of the merchandise storing, displaying, and holding members and into the apertures of the elongated posts to interlock the merchandise storing, displaying and holding members to the elongated posts; with at least two adjacent perimeter posts having a unit access opening; means for preventing the coverings from damaging the merchandise storing, displaying and holding members and the merchandise located thereon comprising perimeter edge extenders located at least on the corner posts of the unit having top and bottom cam contoured edges and an elongated side for engaging with the covering in its unrolled position; and the posts, the post separation and connector members, the intersecting strips forming the lattice grids, the merchandise storing, displaying and holding members, the dowels, and the perimeter edge extenders being formed of non-combustible or fire treated materials so that the modular unit is safe from fire.

2. The modular unit of claim 1 further comprising, in combination: at least one light fixture; and means for removably attaching the light fixture to the modular unit without the use of tools comprising support members including first and second C-shaped ends and a central portion extending between the bottom legs of the C-shaped ends; L-shaped abutments formed in the top legs of the C-shaped ends for supporting and capturing the light fixture; and first and second holding members attached on opposite sides of and extending below the central portion to form an inverted U-shaped opening for receipt of and support onto the post separation and connector members.

3. The modular unit of claim 1 wherein the post separation and connector members which extend to at least one interior post has an inverted T-shape and wherein the post separation and connector members which extend between two perimeter posts has an L-shape.

4. The modular unit of claim 1 wherein the merchandise storing, displaying, and holding members include a peg board comprising, in combination: an elongated, vertical member having first and second ends and a length substantially equal to but less than the spacing between the elongated posts; a plurality of merchandise holding pegs extending generally horizontally from the vertical member between the first and second ends; and post attachment members attached to the first and second ends of the vertical member, with the apertures of the merchandise storing, displaying and holding members being formed in the post attachment members.

5. The modular unit of claim 1 wherein the merchandise storing, displaying, and holding members include a shelf member comprising, in combination: an elongated, horizontal shelf having first and second ends and a length substantially equal to but less than the spacing between the elongated posts; and post attachment members having a shape of an isosceles trapezoid, with the apertures of the merchandise storing, displaying, and holding members being formed in the post attachment members, with the first and second ends of the horizontal shelf resting upon and supported by the base of the isosceles trapezoid shaped post attachment members; and double sided tape adhered between the shelf and the post attachment members.

6. The modular unit of claim 5 wherein the shelf is formed of glass.

7. The modular unit of claim 5 wherein the shelf is formed of wood, and wherein the shelf further comprises end members upstanding from the first and second ends of the shelf.

8. The modular unit of claim 1 wherein the merchandise storing, displaying, and holding members include cabinets having first and second ends and a length substantially equal to but less than the spacing between the elongated posts.

9. The modular unit of claim 1 wherein the perimeter posts have apertures only in the surfaces which face another post and do not have apertures on perimeter surfaces.

10. The modular unit of claim 1 further comprising panels for at least partially closing the space between adjacent posts.

11. The modular unit of claim 1 further comprising a sales counter extending from one of the perimeter posts of the unit access opening and an interior post.

* * * * *